US005791466A

United States Patent [19]

Tsals

[11] Patent Number: 5,791,466

[45] Date of Patent: Aug. 11, 1998

[54] MEDICAMENT CONVERSION SYSTEM

[75] Inventor: Izrail Tsals, Sudbury, Mass.

[73] Assignee: Elan Medical Technologies Limited, Athlone, Ireland

[21] Appl. No.: 709,486

[22] Filed: Sep. 6, 1996

Related U.S. Application Data

[60] Provisional application No. 60/003,559, Sep. 7, 1995.

[51] Int. Cl.[6] ..... B65D 25/08

[52] U.S. Cl. ..... 206/222; 604/82; 604/87

[58] Field of Search ..... 206/219, 222, 206/568; 604/82, 83, 86, 87, 88, 416

[56] References Cited

U.S. PATENT DOCUMENTS

| | | |
|---|---|---|
| 3,490,437 | 1/1970 | Bakondy et al. . |
| 4,259,956 | 4/1981 | Ogle . |
| 5,169,388 | 12/1992 | McPhee . |
| 5,466,220 | 11/1995 | Brenneman . |
| 5,489,266 | 2/1996 | Grimard . |

FOREIGN PATENT DOCUMENTS

| | | | |
|---|---|---|---|
| 0 664 137 | 7/1995 | European Pat. Off. . | |
| WO 86/05683 | 10/1986 | WIPO . | |
| WO 92/18177 | 10/1992 | WIPO | A61M 5/24 |

*Primary Examiner*—Paul T. Sewell
*Assistant Examiner*—Nhan T. Lam
*Attorney, Agent, or Firm*—Kathleen L. Maher

[57] ABSTRACT

A system for converting a medicament from a storage form to an administrable form comprises an evacuted medicament container, a container for a liquid, and means in the form of a hollow needle for establishing communication between said containers and thereby causing liquid to be drawn by suction from the liquid container to the medicament container. By establishing communication between an evacuated container and an unevacuated container, there is an instant, reliable and controlled addition of liquid to the medicament from the liquid container. The system has particular application to lyophilised medicaments.

32 Claims, 2 Drawing Sheets

MEDICAMENT CONVERSION SYSTEM

This application claims the benefit under Title 35, U.S.C. §119(e) of my U.S. Provisional No. 60/003,559 filed Sep. 7, 1995.

FIELD OF THE INVENTION

This invention relates to systems for converting medicaments from a storage form to an administrable form.

BACKGROUND OF THE INVENTION

It is often desired to store a medicament in a form other than the form in which it is to be administered. There may be a number of reasons for this. Certain medicaments may be unstable in liquid form, and accordingly, if they are to be injected, they must be reconstituted from a solid or semi-solid form. Of particular interest at present are a wide range of medicaments produced by biochemical processes which are most stable when stored in a lyophilised form. Lyophilisation provides a product which is easily reconstitutable by the addition of a suitable solvent. Other medicaments may be provided as microparticles or nanoparticles which can be injected in a suspension formed by the addition of a suitable fluid thereto. Storage of medicaments in dry form can also be advantageous not only in terms of storage stability but also in terms of handling prior to use. Shipping costs and storage space can be reduced dramatically by employing a solid medicament form which is reconstituted, dissolved or diluted before use by, for example, the addition of water for injection.

Reconstituting solid or semi-solid medicaments can be troublesome and can involve the possibility of contamination of the medicament during reconstitution. For example, if a syringe is used to transfer a diluent or solvent to the medicament, contamination can occur, and there is also an inherent risk associated with the use of syringes. A number of systems are available for self administration by a patient such as, for example, pen-type injectors used for insulin administration, and controllable delivery devices such as those disclosed in our own U.S. Pat. No. 5,527,288 and U.S. Ser. Nos. 08/647,954; 60/003,673 and 60/008,499, which references are hereby incorporated by reference. The risks of incorrect procedure or dosing, as well as the possibility of contamination occurring, are obviously increased where the reconstitution step is to be effected by an untrained lay person rather than a skilled professional.

SUMMARY OF THE INVENTION

The invention provides a system for converting a medicament from a storage form to an administrable form, comprising an evacuated medicament container, a container for a liquid, and means for establishing communication between said containers and thereby causing liquid to be drawn by suction from the liquid container to the medicament container.

The system according to the invention is extremely simple to use and inexpensive to make. By establishing communication between an evacuated container and an unevacuated container, there is an instant, reliable and controlled addition of liquid to the medicament from the liquid container.

The skilled person will appreciate that the invention finds particular application in relation to lyophilised medicaments, as an inexpensive evacuation of the medicament container is already present during the lyophilisation process. Thus, the container can be sealed when all of the solvent has been drawn off under vacuum during lyophilisation.

A sealed evacuated container is a sterile and stable environment for a medicament, so advantages arise not only as a result of the ease with which the medicament is reconstituted, but also as a result of the guaranteed quality and sterility of the medicament prior to reconstitution. If the liquid container is also sealed during manufacture, then contamination risks are reduced even further.

Preferably, the medicament container is sealed under vacuum by a penetrable stopper.

This allows for a particularly simple means for establishing communication between the containers, namely by penetrating the penetrable stopper.

Suitably, the means for establishing communication between the containers comprises a hollow needle. Such a hollow needle can be used to pierce both the penetrable stopper and a seal on the liquid container, or it can be already in communication with the liquid chamber and penetrate only the penetrable stopper on the medicament chamber.

Preferably, the tip of the needle is embedded in a seal before use.

This arrangement is preferred for reasons of sterility, and also for reasons of safety to prevent risk of injury from an exposed needle.

According to a first embodiment, the medicament container is removably mounted on said seal. In this embodiment, the system can be supplied as a self-contained unit, with the medicament being reconstituted by pushing the needle through the seal and the stopper and subsequently removing the container from the seal.

According to another embodiment, the medicament container is removably mounted on a plug which accommodates said seal. This embodiment will be further described below, and provides advantages in allowing for more efficient manufacture and assembly of the respective containers.

Suitably, the mounting of the container on the plug is effected by means of complementary formations on the stopper and the plug.

According to a preferred embodiment, the needle extends from the liquid container and the liquid container is provided with a guide for the medicament container to ensure correct penetration of the stopper.

The guide allows a medicament container to be pushed onto the needle causing penetration of the stopper and suction of liquid from the liquid container via the needle. It reduces even further the possibility of operator error arising when reconstituting the medicament.

Preferably, the liquid container comprises a collapsible vessel. Further, preferably, the medicament container comprises a glass vial.

Accordingly, the system in one embodiment can be described as a "vial and pouch" system comprising a glass vial and a collapsible pouch. The vial used can be of any type desired, including standard vials for use with a syringe, "insulin-type" vials for use with pen injectors, or custom-made vials adapted for use with any other type of medicament delivery device.

Suitably, the medicament container is cylindrical and the stopper makes a leakproof sliding fit with the interior thereof.

Such a vial can be used to fill a medicament delivery device by pushing the container onto a filling mechanism comprising a rod having a hollow needle extending therefrom such that the needle penetrates the stopper and the stopper abuts against the rod. Continued movement of the cylinder causes the stopper to act as a piston delivering medicament via the hollow needle through an internal conduit in the rod. The filling mechanism can be integral with or separate from the medicament delivery device.

According to a preferred embodiment, the stopper or the medicament container is provided with a formation providing a vapour path when the stopper is partially inserted into the container, which path is blocked by the total insertion of the stopper into the container.

As will be described below, this arrangement is particularly advantageous for use with a lyophilised medicament, as the stopper can be partially inserted into the container during the lyophilisation process, allowing the vaporised solvent to be drawn off from the medicament. When lyophilisation is complete, the stopper is inserted fully into the container, thereby blocking the vapour path and sealing the contents of the container under vacuum.

The invention also provides a medicament container as such, for use in a system according to the invention, comprising a container body having a medicament therein sealed under vacuum by a penetrable stopper.

Preferably, for such a container, the medicament is a solid or semi-solid and the interior of the sealed container body contains an amount of space sufficient to accommodate a volume of liquid required to dilute, suspend or dissolve the medicament for subsequent injection.

In another aspect, the invention provides a liquid container for use in a system according to the invention, comprising a collapsible body having a hollow needle extending therefrom.

Preferably, the needle is embedded in a seal before use, and the liquid container further comprises a guide for a medicament container having a penetrable stopper, the guide ensuring the correct penetration of the stopper.

BRIEF DESCRIPTION OF THE DRAWINGS

The invention will be further illustrated by the following description of embodiments thereof given by way of example only with reference to the accompanying drawings in which.

DETAILED DESCRIPTION OF THE INVENTION

Figure 1:
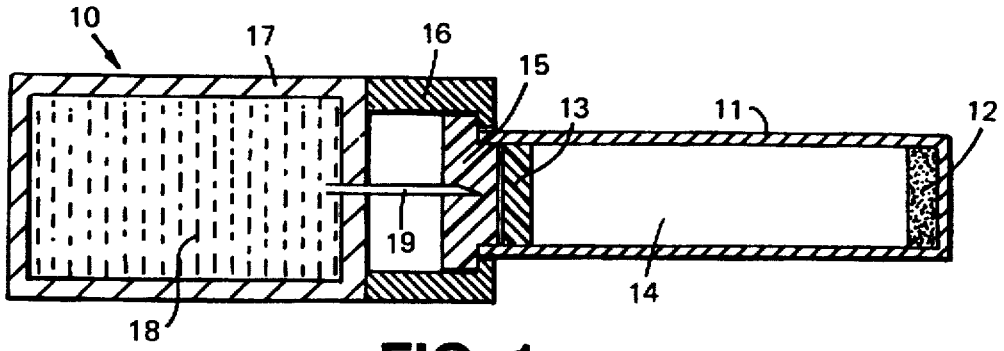
FIG. 1 illustrates a system according to the invention, before use.

In FIG. 1, there is illustrated, generally at 10, a system according to the invention for converting a medicament from a storage form to an administrable form. The system 10 comprises a medicament container 11 having a quantity of lyophilised medicament 12 therein. Container 11 is sealed by an elastomeric stopper 13 under vacuum such that enclosed space 14 is evacuated.

Medicament container 11 is mounted on a plug 15 positioned in a guide 16 which is provided on a liquid container 17. Container 17 is a flexible foil pouch holding a quantity of solvent 18 suitable to fill medicament container 11 and dissolve lyophilised medicament 12. A hollow needle 19 leads from liquid container 17 and penetrates into but not through plug 15.

Figure 2:
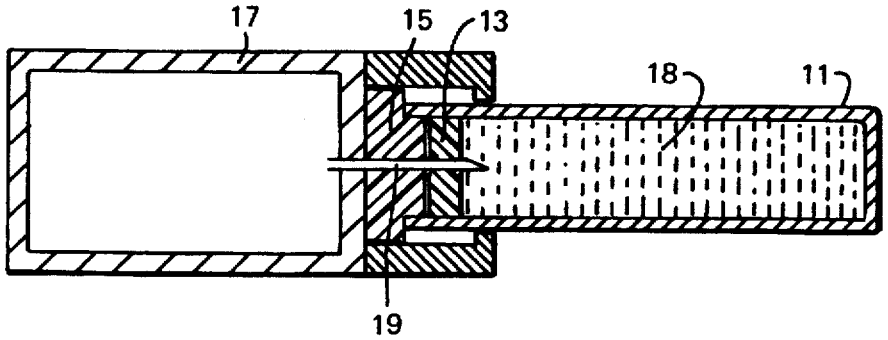
FIG. 2 illustrates a system according to the invention, during the step of reconstitution of a medicament.

Referring additionally to FIG. 2, it can be seen that in use, medicament container 11 and liquid container 17 are pushed together such that container 11 moves within guide 16 causing needle 19 to pierce through plug 15 and stopper 13, thereby effecting communication between the two containers 11, 17. This communication causes solvent 18 to be drawn from liquid container 17 into medicament container 11 by suction as a result of the vacuum which has been established in medicament container 11. Solvent 18 dissolves lyophilised medicament 12, resulting in medicament container 11 being filled with a solution of medicament 12 which is suitable for injection. As medicament container 11, needle 19 and liquid container 17 formed a completely enclosed system from the time of supply until the dissolution of substance 12, no contamination of the medicament can have occurred.

Figure 3:
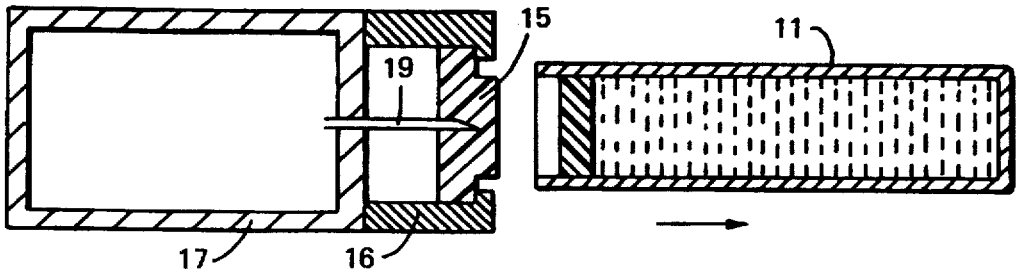
FIG. 3 illustrates the same system as depicted in FIG. 2, after reconstitution.

FIG. 3 illustrates the removal of container 11 from guide 16. Container 11 is pulled in the direction indicated by the arrow, whereupon it draws plug 15 back to its starting position concealing needle 19. Continued movement of container 11 disengages it from plug 15, resulting in a filled medicament container 11 and a safely disposable and empty liquid container 17 which comprises a flattened pouch having a concealed needle extending therefrom embedded in a plug.

The entire process of reconstituting medicament 12 is fast and efficient. When container 11 is pushed onto needle 19, the vacuum causes the immediate filling of the medicament container 11 which can then be pulled away from container 17 without delay. It will be apparent to the skilled person that the mechanism illustrated in FIGS. 1–3 is extremely simple, free of potential problems, reliable and above all inexpensive to manufacture and easy to use. The simplicity of manufacture and use are emphasised by comparing the present invention with embodiments of prior art lyophilisation reconstitution devices which usually involve intricate mechanisms for storing and mixing the liquid and solid components of the system.

Figure 4:
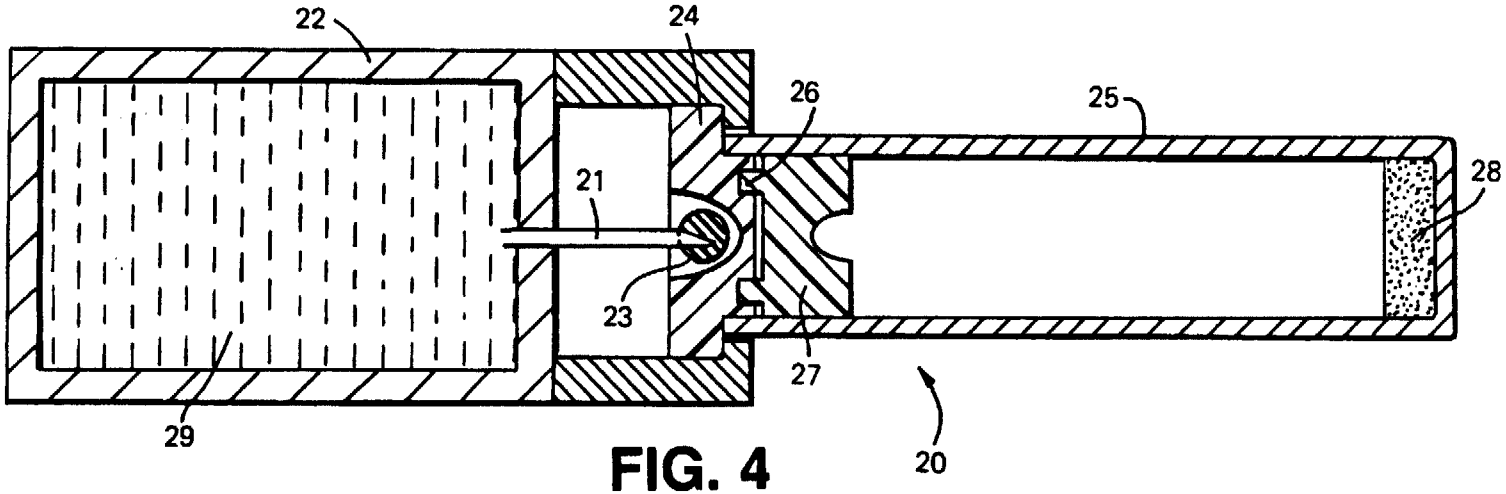
FIG. 4 illustrates an alternative system according to the invention, before use.

Referring now to FIG. 4, an alternative arrangement which operates on the same principle as that involved in the case of the arrangement of FIGS. 1–3 is illustrated. In this system, indicated generally at 20, it can be seen that needle 21 extending from liquid container 22 is protected by a seal 23 which is accommodated within a plug 24 upon which a container 25 is mounted by means of complementary formations 26 between plug 24 and a stopper 27 accommodated within container 25. It will be appreciated that medicament 28 contained within container 25 is reconstituted in exactly the same way as in the system of FIGS. 1–3. In other words, container 25 is pushed towards container 22, causing the piercing of seal 23, plug 24 and stopper 27. This allows communication between the two containers and causes the suction of liquid 29 into medicament container 25 and the consequent reconstitution of medicament 28. When container 25 is pulled away, plug 24 moves back to its original position, thereby completely concealing needle 21, and subsequent movement of container 25 disengages stopper 27 and plug 24.

Figure 5:
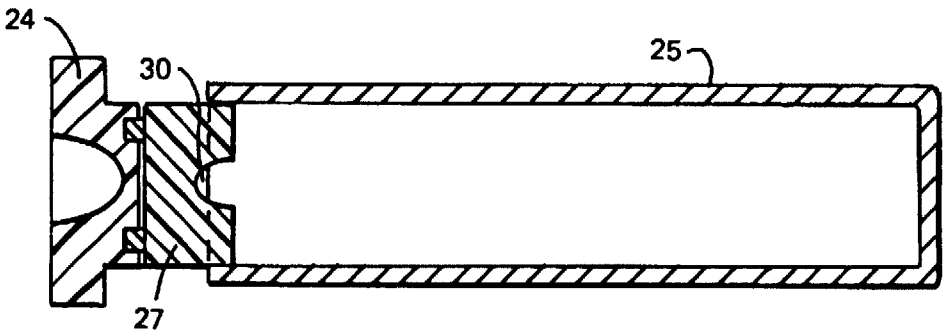
FIG. 5 shows the medicament container of the system of FIG. 4, illustrated during lyophilisation, before being assembled as part of a complete system.

FIG. 5 illustrates an additional feature of the system of FIG. 4 which allows for increased efficiency in evacuating container 25. It can be seen that stopper 27 is provided with a groove 30 which allows communication between the interior and exterior of the device when stopper 27 is only partially inserted into container 25 (as shown). Thus, if container 25 is to be filled with a lyophilised substance, the substance can, prior to lyophilisation, be capped by stopper 27 in the configuration shown in FIG. 5. Lyophilisation can then proceed, with groove 30 providing a vapour path to allow the freeze drying of the substance within container 25, and when evaporation of the solvent is complete, while container 25 is still within a vacuum, plug 24 and stopper 27 can be pushed home, thereby sealing the contents of container 25 in a sterile condition under vacuum, allowing container 25 to be fitted to a liquid container such as container 22 illustrated in FIG. 4. The invention is not, however, limited to the reconstitution of lyophilised medicaments. It also covers the dissolution, dilution and suspension of any suitable solid, semi-solid or concentrated medicament, as well as the mixing of the components of a medication having two active ingredients.

What is claimed is:

1. A system for converting a medicament from a storage form to an administrable form, comprising:

a medicament container sealed under vacuum by a stopper;

a plug covering the stopper;

guide means supporting the plug;

a liquid container having liquid therein;

a hollow needle extending between the liquid container and the plug, the needle having a first end and a second sharpened end, the first end in communication with the liquid in the liquid container and the sharpened end embedded in the plug, whereby movement of the medicament container along the guide means towards the liquid container causes the sharpened end of the needle to pierce the plug and stopper thereby causing liquid to be drawn by suction from the liquid container to the medicament container, and separation of the medicament container from the liquid container and guide means after depletion of the liquid container, causes the sharpened end of the needle to become re-embedded in the plug thereby resulting in an emptied liquid container for safe disposal and a separate medicament container ready for administration.

2. A system according to claim 1, wherein the medicament container is removably mounted on said stopper.

3. A system according to claim 2, wherein the plug has an annular groove for receiving the medicament container and stopper.

4. A system according to claim 1, wherein the guide means is dimensioned so as to ensure that the sharpened end of the needle does not penetrate the stopper prior to use, and that the sharpened end of the needle is re-embedded into the plug after separation of the medicament container from the liquid container and guide means.

5. A system according to claim 1, wherein the liquid container comprises a collapsible vessel.

6. A system according to claim 1, wherein the medicament container comprises a glass vial.

7. A system according to claim 1, wherein the stopper is slidably removable from the interior of the container while preventing any liquid container in the container from leaking when the stopper is fully received into the interior of the container.

8. A system according to claim 1, wherein the stopper includes a groove on the surface thereof, whereby when the stopper is partially inserted into the container, the groove acts as a vapour path and which path is blocked by the total insertion of the stopper into the container.

9. A medicament container for use in a system according claim 1, comprising a container body having a medicament therein.

10. A medicament container according to claim 9, wherein the medicament is a solid or semi-solid and the interior of the sealed container body contains an effective volume of liquid required to dilute the medicament for subsequent injection.

11. The system according to claim 9, wherein the medicament is a solid or semi-solid and the interior of the sealed container body contains an effective volume of liquid required to suspend the medicament for subsequent injection.

12. The system according to claim 9, wherein the medicament is a solid or semi-solid and the interior of the sealed container body contains an effective volume of liquid required to dissolve the medicament for subsequent injection.

13. The system according to claim 1, wherein the stopper includes a groove on the interior surface thereof, whereby when the stopper is partially inserted into the container, the groove acts as a vapour path and which path is blocked by the total insertion of the stopper into the container.

14. The system according to claim 1 wherein the medicament is lyophilized.

15. The system according to claim 1 wherein the medicament is a solid or semi-solid and the interior of the sealed container body contains an effective volume of liquid required to reconstitute the medicament for subsequent injection.

16. A system according to claim 1, wherein the stopper includes a groove on a portion of the interior surface thereof, whereby when the stopper is partially inserted into the container, the groove acts as a vapour path and when the stopper is totally inserted into the container, the path of the groove is blocked.

17. A method for safely and efficiently converting a medicament from a storage form to an administrable form, comprising the steps of:

sealing under vacuum a medicament container by means of a stopper;

covering the stopper with a plug supporting the plug with a guide means;

providing a liquid container containing liquid therein, the liquid container having a hollow needle extending between the liquid container and the plug, the needle having a first blunt end, and a second, sharpened end, the blunt end in communication with the liquid in the liquid container and the sharpened end embedded in the plug;

moving the medicament container along the guide means towards the liquid container so that the sharpened end of the needle pierces the plug and stopper causing liquid to be drawn by suction from the liquid container to the medicament container; and separating the medicament container from the liquid container and guide means after depletion of the liquid container thereby causing the sharpened end of the needle to become re-embedded in the plug, and resulting in an emptied liquid container for safe disposal and a separate medicament container ready for administration.

18. The method according to claim 17, wherein the medicament container is removably mounted on the stopper.

19. The method according to claim 17, wherein the medicament container is removably mounted on the plug.

20. The method according to claim 19, wherein the plug has an annular groove for receiving the medicament container and stopper.

21. The method according to claim 17, wherein the liquid container comprises a collapsible vessel.

22. The method according to claim 17, wherein the medicament container comprises a glass vial.

23. The method according to claim 17, wherein the medicament container is cylindrical and the stopper makes a leakproof sliding fit with the interior thereof.

24. The method according to claim 17, wherein the stopper includes a groove on the surface thereof, whereby when the stopper is partially inserted into the container, the groove acts as a vapour path and which path is blocked by the total insertion of the stopper into the container.

25. The method according to claim 17, wherein the stopper includes a groove on the interior surface thereof, whereby when the stopper is partially inserted into the container, the groove acts as a vapour path and which path is blocked by the total insertion of the stopper into the container.

26. The method according to claim 17, wherein the medicament container comprises a container body having a medicament therein.

27. The medicament container according to claim 26, wherein the medicament is a solid or semi-solid and the interior of the sealed container body contains an effective volume of liquid required to dilute the medicament for subsequent injection.

28. The medicament container according to claim 26, wherein the medicament is a solid or semi-solid and the interior of the sealed container body contains an effective volume of liquid required to suspend the medicament for subsequent injection.

29. The medicament container according to claim 26, wherein the medicament is a solid or semi-solid and the interior of the sealed container body contains an effective volume of liquid required to dissolve the medicament for subsequent injection.

30. The method according to claim 17 wherein the guide means is dimensioned so that the sharpened end of the needle does not penetrate the stopper prior to use, and that the sharpened end of the needle is re-embedded into the plug after separation of the medicament container from the liquid container and guide means.

31. The method according to claim 17 wherein the medicament is lyophilized.

32. The method according to claim 17 wherein the medicament is a solid or semi-solid and the interior of the sealed container body contains an effective volume of liquid required to reconstitute the medicament for subsequent injection.

* * * * *